United States Patent [19]

Bryant

[11] Patent Number: 4,616,863

[45] Date of Patent: Oct. 14, 1986

[54] LOCK FOR RELEASABLY HOLDING A HINGED GUARD ELEMENT ON A WINDOW

[75] Inventor: Edgar E. Bryant, Mingus, Tex.

[73] Assignee: Ultimate Security Products Corp., Fort Worth, Tex.

[21] Appl. No.: 628,638

[22] Filed: Jul. 6, 1984

[51] Int. Cl.[4] ..... E05C 1/12; E05C 19/00

[52] U.S. Cl. ..... 292/302; 49/56; 292/168; 292/246

[58] Field of Search ..... 49/56, 50, 67, 141; 292/302, 304, 166, 168, 246, 248, DIG. 14, 179, 305

[56] References Cited

U.S. PATENT DOCUMENTS

| | | | |
|---|---|---|---|
| 1,259,397 | 3/1918 | Hathaway | 292/302 X |
| 1,991,822 | 2/1935 | Snipes | 292/166 X |
| 2,504,483 | 4/1950 | Abraham | 292/166 X |
| 2,863,690 | 12/1958 | Lewin | 292/302 |
| 4,055,360 | 10/1977 | Russi | 49/56 X |
| 4,208,837 | 6/1980 | Black | 49/56 |
| 4,263,747 | 4/1981 | Coltrin et al. | 49/56 |

FOREIGN PATENT DOCUMENTS

| | | | |
|---|---|---|---|
| 657284 | 9/1951 | United Kingdom | 292/302 |

*Primary Examiner*—Alexander Grosz
*Assistant Examiner*—Russell W. Illich
*Attorney, Agent, or Firm*—Wofford Fails & Zobal

[57] ABSTRACT

A lock for releasably holding closed a fixed structure like a house or building a hingedly mounted closing element like a window guard, gate or the like characterized by a lock bar for being locked in the closed position from a lock housing that is connectable with the fixed structure and has a latch that is inaccessible by an outsider but that will snap into position about the lock bar to hold it trapped yet releases when pushed from inside the building, the push operating a bell crank that effects the release. The latch includes a trapped, slidable release bar biased to snap into engagement but pushable by the bell crank to release engagement. Specific preferred embodiments are also disclosed.

3 Claims, 4 Drawing Figures

LOCK FOR RELEASABLY HOLDING A HINGED GUARD ELEMENT ON A WINDOW

FIELD OF THE INVENTION

This invention relates to locking apparatus for holding closed an element such as a window guard, gate or the like to prevent ingress, but which allows emergency egress. More particularly, this invention relates to a lock that can be operated manually or electrically to release and that will automatically latch when a hingedly mounted means such as a gate or window guard is swung into place with a lock bar thereon.

DESCRIPTION OF THE PRIOR ART

The prior art has seen the development of a wide variety of types of closures that need a releasable latch. The types of locking apparatus need to be simple such as to be operable manually or electrically and cheap enough to be employed with gates or the like, as well as home security systems such as with window guards.

The home security system has seen the development of a wide variety of window guards, shutters and the like to prevent ingress through a window, doorway or other openings. Such prior art guard apparatus have not been totally satisfactory, since they suffered from one or more of a plurality of disadvantages as follows. Some of the prior art devices completely blocked both egress and ingress and caused inJury and death to people on the inside who were unable to escape in the event of a fire or other emergency. Others such as shutters, were fastened in the middle, were easily opened by burglars or outsiders who sought entry through the aperture guarded by the shutters. Still others had hinges that were easily disassembled to allow entry into the building. Attempts to foil the would-be burglar by employing hooks or the like has proved unsatisfactory. On the other hand, when bolts with nuts screwed on the inside were employed an excessive amount of time has been necessary to release the guard apparatus in the event of an emergency. Moreover, the nuts required tools to be normally operable by women and children; and tended to become rusted or painted in place such that tools were always required for interior release; and the tools frequently were not available. The closest prior art of which the inventor is aware is U.S. Pat. No. 4,208,837 entitled "WINDOW GUARD HAVINC BOXED RELEASE", issued to William R. Black, Sr. and Gerald L. Sams on June 24, 1980. In that patent application, there was cited many other patents including U.S. Pat. Nos. 1,185,422; 2,086,034; 2,680,639; 2,705,884; 3,040,555; 3,451,712, 3,690,132; 3,921,334; 4.055,360; 4,057,935; and 4,070,048. In the patent application for the above-identified U.S. Pat. No. 4,208,837, there was cited the following patents: U.S. Pat. Nos. 810,923; 1,977,165; 2,024,871; 2,749,164; 3,921,334. In particular U.S. Pat. No. 3,921,334 is very pertinent and was distinguished over the other references listed in its group during its prosecution. While these two pertinent patents represent a significant improvement in the state of the art, they were not totally satisfactory in that they required more expensive installations in penetrating through the walls and the like than was deemed necessary. In fact, they were so expensive that their lock could not be economically produced for gates or the like. Moreover, the recess or latch means interiorly of the walls of a building were frequently unsightly to the decor and were not desirable.

Thus, it can be seen that the prior art apparatus was not totally satisfactory in providing a guard for a window and the like, yet, economical enough for a gate and not disruptive to the decor. Consequently, the need persists for a security apparatus that is easily operated by women or children to allow egress, that is economical enough for use on simple closing structures such as gates, and that can be operated manually or electrically.

SUMMARY OF THE INVENTION

Accordingly, it is an object of this invention to provide a locking apparatus for a hingedly mounted closing structure such as a window guard, gate or the like that obviates the disadvantages of the prior art and provides a locking element that can fix the hingedly mounted closing structure to a fixed structure such as a building; yet, allow egress by a person on the interior while preventing ingress by a person on the exterior.

It is also an object of this invention to provide blocking apparatus that effects the foregoing object and additionally can be readily opened by a woman or a child without requiring tools on the inside of a building, that can be operated electrically and be economical enough to be employed on a gate or the like; yet, distinguished enough so as not to mar the decor of a room interiorly of a building or the like.

These and other objects will become apparent from the descriptive matter hereinafter, particularly when taken into conjunction with the drawings.

In accordance with this invention there is provided a locking apparatus, or lock, for holding closed to a fixed structure a hingedly mounted closing element like a window guard. gate or the like, comprising:

a. a lock bar means for being locked in a closed position, the lock bar means being connectable to the closing element and having a penetrating end with a shoulder and adjacent recessed groove on at least two sides;

b. a lock housing that is connectable with a fixed structure and has interiorly thereof a latch means for locking the lock bar means in a closed position; and c. a push bar means for releasing the lock bar means, the push bar means being accessible and operable by an insider inside the fixed structure. The latch means interiorly of the lock housing is inaccessible to an outsider when the lock bar means is inserted in the closed position. The latch means is operable automatically to latch the lock bar means in the closed position when the lock bar means is pushed into the closed position. As indicated, the latch means is accessible to an insider and operable by the insider to release the lock bar means when pushed by a push bar means, either manually or electrically. The latch means includes a trapped, slidable release bar having an aperture adapted to receive the penetrating end of the lock bar means and an extended aperture segment of smaller dimensions defined by sides adapted to engage the recess groove on the lock bar means; biasing means for biasing the release bar to engage the sides of the extended aperture when the recess groove is disposed adjacent thereto by pushing the penetrating end of the lock bar means into the aperture; release bell crank pivotally mounted and having a release arm positioned to push the release bar and release the penetrating end of the lock bar means when pivoted; and means for pivoting the release bell crank. As will be appreciated, the bell crank can be pivoted by pushing with a push bar means manually or it can be pushed by an electrically operated solenoid or the like. Specific preferred structural embodiments are described.

BRIEF DESCRIPTION OF THE DRAWINGS

FIG. 1 is a partial isometric view from the front of a house showing guard element emplaced over aperture such as windows, doors and the like.

DESCRIPTION OF PREFERRED EMBODIMENT(S)

It should be borne in mind that the locking apparatus, or lock, of this invention is widely useful because of its economy and simplicity in manufacturing, including assembly. For example, it can be used on gates where the lock bar means is affixed to the gate, as by an adjustable screw, welding or the like, as will become clearer from the descriptive matter hereinafter; and the gate closed by a suitable means. When the lock bar means is thus snapped into its closed position within the lock, the latch will slip into the recess, or groove and hold it latched in the closed position. The latch can be operated remotely, as by a radio controlled electrical solenoid, push button electrical solenoid, or manual means. On the other hand, the lock can be employed for latching a window guard or the like into place in a building and is amenable to installation without marring the decor of a room on the interior; yet, allowing and faciliating being pushed by a woman or a child to open the window guard to escape, as in the event of a fire or the like. It is in this latter regard that the invention will be described more nearly completely hereinafter, since it is this more elaborate environment in which the closest art is known and in which the invention may have its greatest potential for security. This also has the advantage of facilitating comparison between the prior art and this invention, in illustrating its simplicity and unobviousness.

Figure 1:
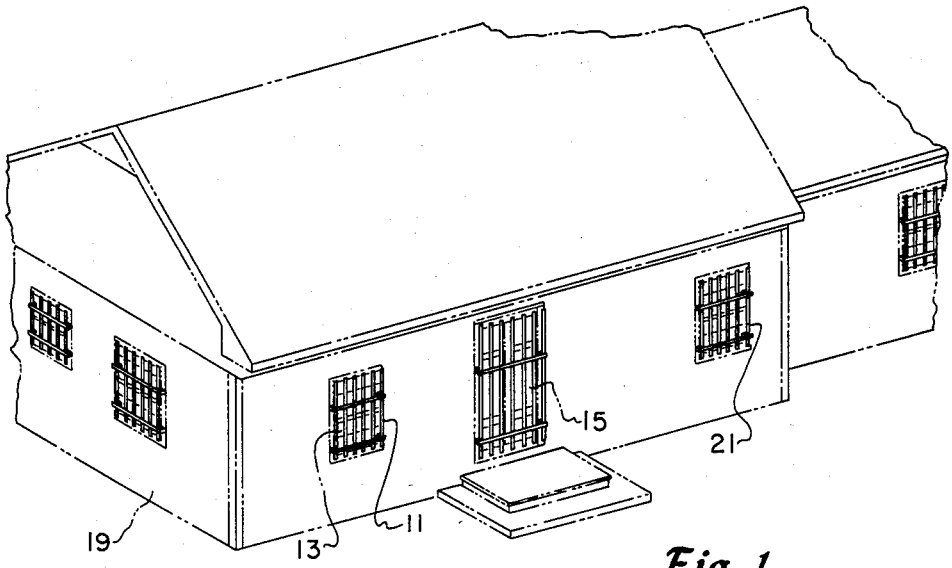

Referring to FIG. 1, the window guards 11 are shown emplaced over windows 13 and door 15 of the house 19. The window guard 11 includes a guard element 21, hinged mount 23, FIG. 2, and releasable lock 25. Thus, in this embodiment, the window guard 11 serves as the hingedly mounted closing element, made up primarily of the guard element 21.

The guard element 21 traverses the length and width of the aperture, such as the window 13, and is adapted to prevent entry into the window from the exterior of the building. The guard element 21 may comprise a solid, opaque shield, such as a steel or aluminum shield, that can be decorated on the exterior or the interior for viewing through the window and blocking out unsightly exterior surroundings; or it can be painted on the outside for suitably decorating old buildings or the like to make them more attractive. As illustrated, however, the guard element 21 comprises a grid that prevents entry through the window and yet allows light invisibility. In any event, the guard element 21 must have the requisite structural strength to provide the security desired. In the illustrated embodiment, the guard element includes a plurality of longitudinally extending bars and a plurality of cross pieces that are formed of materials designed to prevent entry therethrough. Such material ordinarily is metal. Preferably the bars and cross pieces are formed of case hardened, or high carbon-content, steel that cannot be sawed with a hacksaw or the like by a person such as a burglar seeking entry into the house 19. Moreover, the bars should be close enough that the human body cannot squeeze between them, thereby preventing uninvited ingress into the house 19. Cross pieces are spaced to prevent bowing of the bars to allow such ingress. The guard element 21 is hingedly mounted by way of the hinged mount 23 to allow swinging for proper egress.

Figure 2:
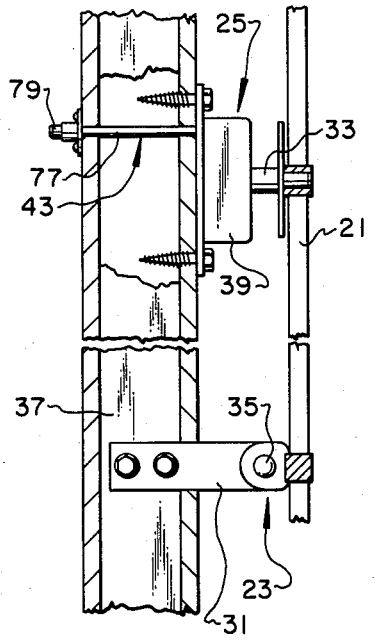
FIG. 2 is a partial side elevational view, partly in section, partly cut away, of an embodiment of FIG. 1 showing the hinged window guard and the releasable lock of this invention.

The hinge mount 23 comprises a building member 31, FIG. 2 and a hinge shaft 35. The building member 31 is permanently connected to a suitable structural element, such as a wall stud 36 of the house 19. As illustrated, the building member 31 is connected with the stud 36 by way of bolts and nuts (the bolts are not being shown since they are located interiorly of the wall and inaccessible to the person either inside or outside the building). Moreover the heads of the bolts will be suitably covered, as by a window jam, plastics or the like so as to be inaccessible to a burglar or persons seeking entry through the window. In addition, the building member 31 should be formed of case hardened steel or similar material that cannot be sawed with a hacksaw or the like, similarly as described hereinbefore with respect to the bars and the crosspieces of the guard element 21.

As a part of the lock 25, there is included a lock bar means 33 for locking the top of the illustrated window guard 11 into place to prevent it being pivoted outwardly. The lock bar means is provided for being locked into a closed position by it being inserted through an aperture in the lock, including the outer housing and other elements interiorly therewithin, as will be understood more nearly completely from the descriptive matter and drawings, as discussed later hereinafter.

The lock bar means 33 is described in more detail later hereinafter. At this point it is believed sufficient to note the following. It is suitably connected with the guard element 21, as by welding, bradding, adjustable yet inaccessible screw or the like. The lock bar means 33 is aligned with the aperture in the lock housing 39 and the respective elements interiorly thereof, FIGS. 2 and 3. For example, as illustrated, it is inserted into an aperture and welded in place with a guard plate 38 over it. The lock bar means, similarly as described with respect to the other elements is preferably formed of case hardened steel or the like and cannot be sawed with a hacksaw or similar tool carried by a burglar, or other persons seeking ingress into the house 19.

The hinge shaft 35 is disposed through mating apertures of the building member 31 and the guard element member 33 and serves as a fulcum about which the guard element 21 can be pivoted to allow egress by a person inside the house 19. The hinge shaft 35 is irremovably positioned in the respective apertures (not shown), as by being bradded or riveted in place. As illustrated, the hinge shaft 35 comprises a case hardened shaft and has a case hardened head on one end and is permanently and fixedly connected with a head on the other end. For example, the heads can be enlarged by brazing or the like although this may be difficult with case hardened steel. Preferably, a case hardened nut is screwed onto threads on the end of a case hardened stud bolt and head; and, thereafter, the nut is welded into place such that it cannot be removed or severed from the bolt. This is preferable to bradding which is sometimes not strong enough. Riveting can also be employed if desired.

In any event, the final hinge mounting means 23 is permanently affixed to the walls of the house adjacent the window; for example, near the bottom, top, or one side and allows pivotal movement of the guard element 21 to open and allow egress of a person inside the window when the releasable lock 25 is released from the interior of the house 19, as will become clearer hereinafter.

The lock housing 39 is connected with the building and is operable to hold the guard element closed against egress from within or ingress from without when locked in its closed position. The lock 25 is releasable by a person interiorly of the building for emergency egress, however. The releasable lock 25 includes, in addition to the lock bar means 33 and the lock housing 25, a push bar means 43 for releasing the guard element.

As implied in the foregoing, the lock bar means 33 is provided for locking the guard element into its closed position; and is connected with the guard element and lockably positionable within the lock housing 39 by insertion of its free end through suitable apertures. As illustrated, the lock bar means is in the form of a cylindrical bar for insertion within a circular aperture in the lock housing 39 and locking into position. The lock bar means has a shoulder 45 with a frusto-conical end 46 to facilitate insertion within a circular aperture in the lock housing 39 and locking into position. Adjacent the shoulder there is positioned a groove 47 on at least two sides for being releasably latched in the closed position. If desired, the lock bar means can have a cross-sectional shape other than circular, for example, square or hexagonal. The round, or cylindrical shape facilitates forming the aperture in the lock housing 39 and the interior elements.

The lock housing 39 is connected with the building 19 as can be seen in FIG. 2 by way of difficultly removable means such as one-way screws, bolts with inaccessible nuts or the like. If desired, a strap may be affixed, as by welding or the like to cover the screws. The housing 39 is made of steel or other material that resists being torn apart by a burglar or other outsider seeking ingress. Preferably, the housing 39 is formed in a plurality of sections, such as two sections, that can be irreversibly joined together after the interior works and suitable elements, including apertures, are properly formed and assembled. If desired, the housing may include a flat plate with a rectangular shaped housing that can be screwed thereonto, with or without a protective strap. If desired, the protective strap may be formed over the screws or the like so it is virtually impossible to be taken apart by a burglar seeking ingress. On the other hand, where an economical version is desired, as for gates or the like, the protective strap may be omitted. This type of structure has been discussed and illustrated in the aforementioned patents U.S. Pat. Nos. 3,921,334 and 4,208,837 and the descriptive matter of these patents is included herein by reference for details that are omitted herefrom.

The housing 39 has a cavity interiorly thereof enclosing a latch means 50 for locking the latch bar into its closed position.

The latch means 50 is inaccessible to an outsider when the lock bar means is inserted and in the closed position. The latch means 50 is operable automatically to lock the lock bar means into its closed position when the lock bar means is pushed into the closed position. The latch means 50 is accessible to an insider and operable to release the lock bar means when pushed by a push bar means 43, either manually or electrically.

Figure 3:
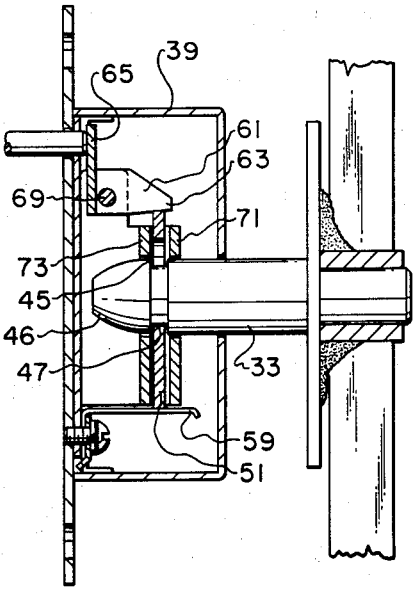
FIG. 3 is a partial cross-sectional view, showing the interior of the lock of FIG. 2.
Figure 4:
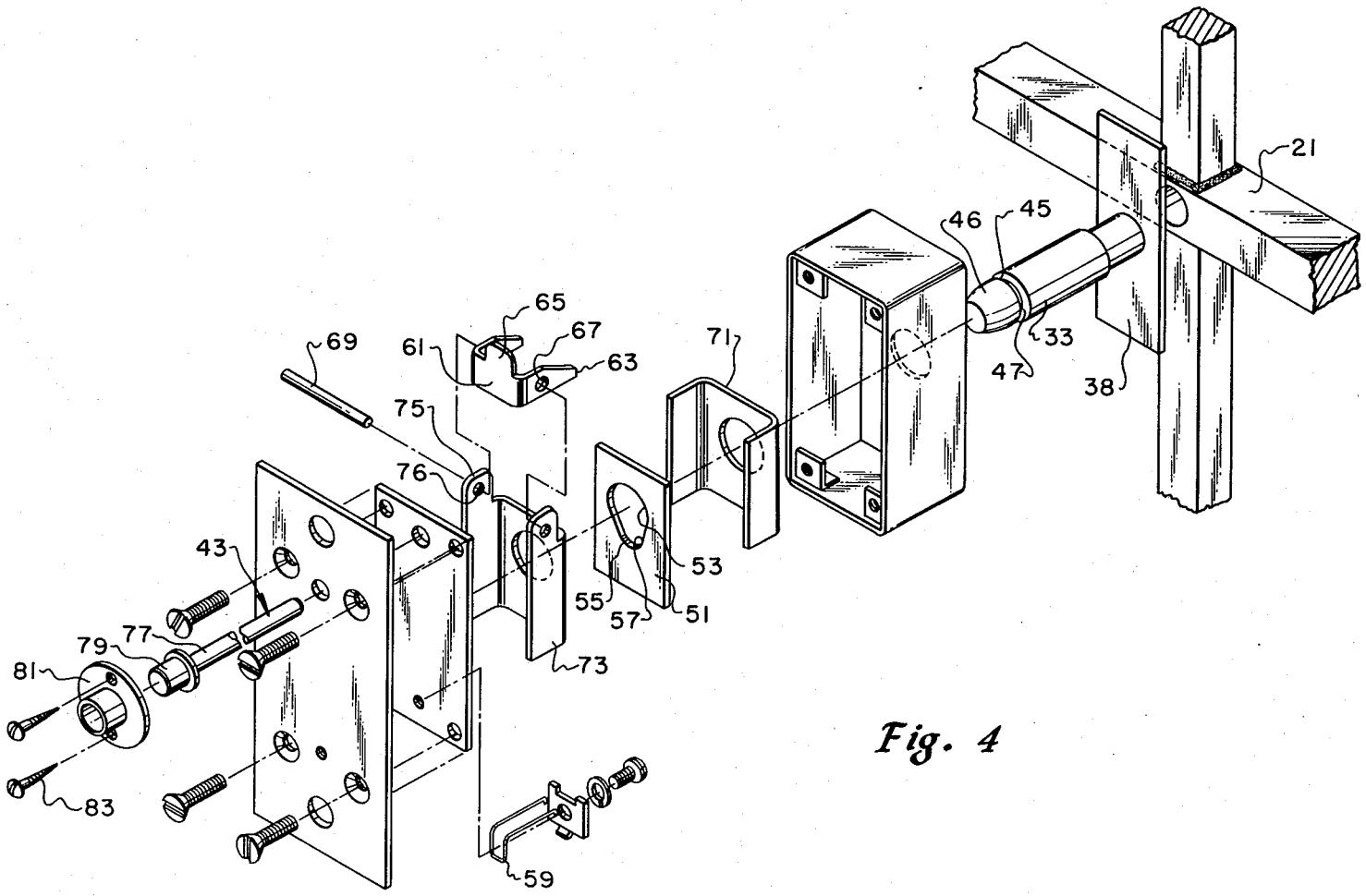
FIG. 4 is a partial exploded isometric view of the lock of FIG. 3.

Specifically, as illustrated in FIGS. 3 and 4, the latch means includes a trapped, slidable release bar having aperture 53 adapted to receive a penetrating end, or frusto-conical end, 46 of the lock bar means 33 having an extended aperture segment 55 of smaller dimensions defined by sides 57 adapted to engage the recessed groove 47 on the lock bar means 33 when it is in the closed position.

The latch means 50 also includes a biasing means in the form of spring 59 for biasing the release bar to engage the sides of the extended aperture with the groove when the recessed groove is disposed adjacent thereto by pushing the penetrating end of the lock bar means into the aperture 53 until the shoulder passes the aperture. Latch means 50 also includes a bell crank 61 pivotally mounted and having a release arm positioned to push the release bar and release the penetrating end of the lock bar means 33 when the bell crank is pivoted. Specifically, the bell crank includes two upright striker portions 63 and an actuator portion 65. The bell crank also includes apertures 67 for receiving therethrough a pin shaft 69 and being moved pivotally thereabout.

Specifically, the release bar 51 is trapped between an interior cover 71 and an interior base 73. If desired lubricant such as grease can be employed to facilitate reciprocal movement. The cover 71 is shorter than the release bar and disposed intermediate the release bar and the lock housing. The base includes extended support members 75 having apertures 76 in their extended ends for receiving the pin shaft 69 and supporting the bell crank 61. As can be seen, in FIGS. 3 and 4, the bell crank 61 can be pushed by pushing of the push bar means 43 against the actuator portion 65 to cause the striker portion 63 to slide the release bar 51 to release the shoulder 45 on the bar 33. As illustrated, the groove 47 goes peripherally entirely around the lock bar means 33 although it is only necessary to have it on two sides if care is taken in assembly. The entire groove is easier to machine and easier to assemble so it is preferred.

Respective elements of the latch 50 are preferably formed of structurally strong material such as steel, aluminum or the like. If desired, soft steel or other easily machinable material may be employed, since the latch means 50 is not accessible to the exterior or exposed to a hacksaw or the like. Yet, the soft steel has adequate strength to hold the lock bar means until released by pushing the push bar means 43.

As implied hereinbefore the push bar means 43 can be operated by an electrically operated solenoid, pneumatic or hydraulic ram or the like to effect the release of the lock bar means 33 and ultimately the closable element. As illustrated herein, the push bar means 43 protrudes interiorly of the building and is operable by simply pushing to release the latch means 50 and consequently, release the guard element 21. Moreover, the push bar means may comprise a plurality of different diameter push bars operated in sequence. As illustrated, however, the push bar means is a single substantially unitary rod. The rod does have a smaller diameter portion 77 penetrating through the wall with an enlarged, hat-shaped portion 79 facilitating pushing from the interior of the house. The hat-shaped portion 79 is retained in place by an outer holder 81 that can be screwed as by screws 83 to the interior wall or the like.

In operation, the respective bars and cross-pieces are assembled into the guard element, or window guard 11. The finished window guard 11 is then connected with the building member 31 by way of the pin shaft 35 for pivotal movement; and with the lock bar means 33 for being moved into the closed position and held there. Expressed otherwise, the window guard element 21 is hingedly mounted with the lock bar means 33 in place for locking.

The lock housing 39 is aligned such that its aperture will receive the lock bar means 33. The lock housing is then affixed in place, as by way of screws, bolts, or welding to a protective strap. The interior elements in the lock housing 39 will have been assembled and emplaced, of course, before the housing is affixed to the building 19. The interior portion 79 of the push bar means 43 is emplaced such that it will be present to be pushed to facilitate egress in the event of an emergency, as by being held in its aperture by the outer holder 81. As can be seen in FIG. 3, the interior end of the interior portion 77 protrudes through an aperture in the base plate 85 such that when pushed, it will depress the actuator portion 65 of the bell crank to effect release of the lock bar means so that the window guard or guard element 21 can be pushed from the top to allow egress.

If desired, of course, the entire push bar means 43 can be held in place, as on a clip, chain or the like, but insertion in smoke can present a problem. Therefore, it is preferable to employ the illustrated embodiment with the push bar means 43 already in place, thereby eliminating the problem with having the push bar means 43 on a chain, or clipped in place which increases the difficulty of inserting it properly in a smoke filled atmosphere or under other emergency conditions. Moreover, the illustrated embodiment is less obtrusive to the interior decorator, as well as being safer.

Thus it can be seen that with this embodiment all that is necessary is to push on the interior portions 79 protruding interiorly of the room and release the release bar 51 from engagement with the groove 47 on the lock bar means 33 such that the guard element can be pushed outwardly. This can be done by even small children, a woman or the like, if properly designed and installed.

In the illustrated embodiment, the lock bar means has been shown welded directly to the guard element such that it closes directly and simply when it is snapped into place. If desired, suitable hinged mounting means can be employed for greater flexibility in alignment. Such mounting means complicates closure following egress and is more expensive in assembling the lock bar means.

From the foregoing, it can be seen that this invention effects the objects delineated hereinbefore and alleviates problems with the disadvantages of the prior art structures.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A lock for releasably holding closed to a fixed structure such as a building or the like a hingedly mounted closing element such as a guard element on a window, consisting essentially of:

a. a lock bar means for being locked in a closed position; said lock bar means having a penetrating end with a shoulder and adjacent recessed groove on at least two sides; said lock bar means being connectable with said guard element that are hingedly mounted over said window opening;

b. a lock housing that is connectable with the building and has interiorly thereof a latch means for locking said lock bar means in the closed position; said latch being inaccessible to an outsider when said lock bar means is inserted and in the closed position; said latch means being operable atuomatically to lock said lock bar means in the closed position when said lock bar means is pushed into the closed position; said latch means being accessible to an insider and operable to release said lock bar means when pushed by a push bar means; said latch means including:

i. a trapped slideable release bar having an aperture adapted to receive said penetrating end of said lock bar means and an extended aperture segment of smaller dimensions defined by sides adapted to engage said recessed groove on said lock bar means;

ii. biasing means for biasing said release bar to engage said sides of said extended aperture when said recessed groove is disposed adjacent thereto by pushing said penetrating end of said lock bar means into said aperture;

iii. release bell crank pivotally mounted and having a release arm positioned to push said release bar and release said penetrating end of said lock bar means when pivoted; and iv. means for pivoting said release bell crank; and c. said push bar means for releasing said lock bar means, said push bar means being accessible and operable by said insider; said push bar means comprising two portions, an interior portion extending interiorly of said building disposed in a wall aperture for pushing on said latch means to release said lock bar means; and an exterior portion; said exterior portion comprising a small diameter shaft with a shoulder on its interior end with a retainer washer on its exterior end; and a first small diameter passageway encompassing said small diameter shaft;

wherein said release bar is slideably trapped between a cover and a base, said cover is shorter than said release bar and disposed intermediate said release bar and said lock housing; said bar includes extended support members having apertures at their extended ends, said bell crank including two upright striker portions and an actuator portion and is journalled by apertures for pivotal movement about a pin shaft, said pin shaft being inserted within said apertures of said extended ends and said pivotal bell crank such that said bell crank can be pivoted by a force on said actuator portion to slide said release bar and release said lock bar means.

2. The lock of claim 1 wherein said actuator portion is adapted to be pushed by said push bar means.

3. The lock of claim 2 wherein said groove extends peripherally around said lock bar means.

* * * * *